US011566867B2

(12) United States Patent
Clawson et al.

(10) Patent No.: US 11,566,867 B2
(45) Date of Patent: Jan. 31, 2023

(54) FIREARM HOLSTER ASSEMBLY, CLIP AND CLAW ASSEMBLY, AND RELATED METHODS

(71) Applicant: Tier 1 Manufacturing, Inc., Ogden, UT (US)

(72) Inventors: Jared Clawson, Eden, UT (US); Jackson Clawson, Perry, UT (US); Taylor Barlow, Ogden, UT (US)

(73) Assignee: Tier 1 Manufacturing, Inc., Ogden, UT (US)

( * ) Notice: Subject to any disclaimer, the term of this patent is extended or adjusted under 35 U.S.C. 154(b) by 32 days.

(21) Appl. No.: 16/948,132

(22) Filed: Sep. 3, 2020

(65) Prior Publication Data

US 2022/0011073 A1 Jan. 13, 2022

Related U.S. Application Data

(63) Continuation-in-part of application No. 29/652,280, filed on Jul. 8, 2020, now Pat. No. Des. 913,685.

(51) Int. Cl.
*F41C 33/04* (2006.01)

(52) U.S. Cl.
CPC ..... *F41C 33/041* (2013.01); *F41C 33/048* (2013.01)

(58) Field of Classification Search
CPC .... F41C 33/041; F41C 33/048; F41C 33/043; F41C 33/0209
See application file for complete search history.

(56) References Cited

U.S. PATENT DOCUMENTS

| | | | | |
|---|---|---|---|---|
| 7,331,872 | B1 * | 2/2008 | Parsons | A45F 5/02 224/195 |
| D675,087 | S | 1/2013 | Gary et al. | |
| D675,509 | S | 2/2013 | Gary et al. | |
| D897,332 | S | 9/2020 | Zhang et al. | |
| 2008/0283563 | A1 | 11/2008 | O'Donnell et al. | |
| 2017/0122701 | A1 | 5/2017 | Lim et al. | |
| 2021/0025671 | A1 * | 1/2021 | Moultrie | F41C 33/04 |
| 2022/0155042 | A1 * | 5/2022 | Considine | F41C 33/046 |

OTHER PUBLICATIONS

Fierce Defender, "Fierce Defender IWB Holster Compatible with Glock 19 23 32 w/Tuckable Clip and Claw The Uninfringed Series—Made in USA—Gen 5 Compatible", Mar. 28, 2019, https://www.amazon.com/Fierce-Defender-Tuckable-Uninfringed-Compatible/dp/B07HCNGYHY/ref=cm_cr_arp_d_product_top?ie=UTF8&th=1 (Year: 2019).*

* cited by examiner

*Primary Examiner* — Corey N Skurdal
(74) *Attorney, Agent, or Firm* — TraskBritt

(57) ABSTRACT

A firearm holster assembly includes a firearm receiving portion and a clip and claw assembly. The clip and claw assembly includes a clip element configured to engage a piece of clothing of a wearer and a claw assembly. The claw assembly includes a base plate movably coupled to the firearm receiving portion and one or more spacer plates. The base plate includes a connection portion oriented between the clip element and the firearm receiving portion and a projecting element extending outward laterally from the connection portion, the connection portion and the projecting element together defining a first major surface and a second opposite major surface of the base plate, the first major surface configured to face outward from a body of a wearer. The one or more spacer plates are stacked on the first major surface of the base plate.

19 Claims, 9 Drawing Sheets

FIREARM HOLSTER ASSEMBLY, CLIP AND CLAW ASSEMBLY, AND RELATED METHODS

CROSS-REFERENCE TO RELATED APPLICATIONS

This application is a continuation-in-part of U.S. patent application Ser. No. 29/652,280, filed Jul. 8, 2020.

TECHNICAL FIELD

The disclosure relates to inside-the-waistband firearm holster assemblies and clip and claw assemblies for the same.

BACKGROUND

Holsters intended for discreetly carrying a defensive handgun are commonly used by private citizens and plain-clothes or off duty police officers. Most people who carry a handgun prefer to carry it at belt level, positioned on or slightly behind the strong side hip. A few prefer to carry the gun on or slightly in front of the weak side hip, commonly known as crossdraw carry.

One style of concealment holsters includes an inside-the-waistband holster. Such holsters are sometimes worn inside the waistband of the wearer's pants, slightly behind the strong side hip, with only the upper lip of the holster and grip of the gun protruding from the pants. Such holsters are also sometimes worn inside the waistband of the wearer's pants in the front of the pants against a lower abdomen of the wearer, also known as an "appendix carry." A belt clip or loop secures the holster to the wearer's belt. The top of the holster is covered by a jacket, sweater, or untucked shirt.

BRIEF SUMMARY

Some embodiments include an inside-the-waistband firearm holster assembly. The firearm holster assembly may include a firearm receiving portion and a clip and claw assembly coupled to the firearm receiving portion. The clip and claw assembly may include a clip element configured to engage a piece of clothing of a wearer and a claw assembly. The claw assembly may include a base plate movably coupled to the firearm receiving portion and one or more spacer plates. The base plate may include a connection portion oriented between the clip element and the firearm receiving portion and a projecting element extending outward laterally from the connection portion. The connection portion and the projecting element together may define a first major surface and a second opposite major surface of the base plate. The first major surface may be configured to face outward from a body of the wearer. The one or more spacer plates may be coupled to and stacked on the first major surface of the first and second major surfaces.

Some embodiments include a clip and claw assembly for attaching a firearm holster assembly to one or more pieces of clothing of a wearer. The clip and claw assembly may include a clip element configured to engage a piece of clothing of the wearer and a claw assembly. The claw assembly may include a base plate and one or more spacer plates. The base plate may include a connection portion oriented adjacent to the clip element and a projecting element extending outward laterally from the connection portion, the connection portion and the projecting element together defining a first major surface and a second opposite major surface of the base plate. The first major surface may be configured to face outward from a body of the wearer.

Some embodiments include a method of making a clip and claw assembly. The method may include forming a claw assembly including: forming a base plate including: forming a connection portion and forming a projecting element extending outward laterally from the connection portion, the connection portion and the projecting element together defining a first major surface and a second opposite major surface of the base plate, the first major surface configured to face outward from a body of a wearer, and forming one or more spacer plates and stacking the one or more spacer plates on the first major surface of the base plate.

DETAILED DESCRIPTION

Figure 1:
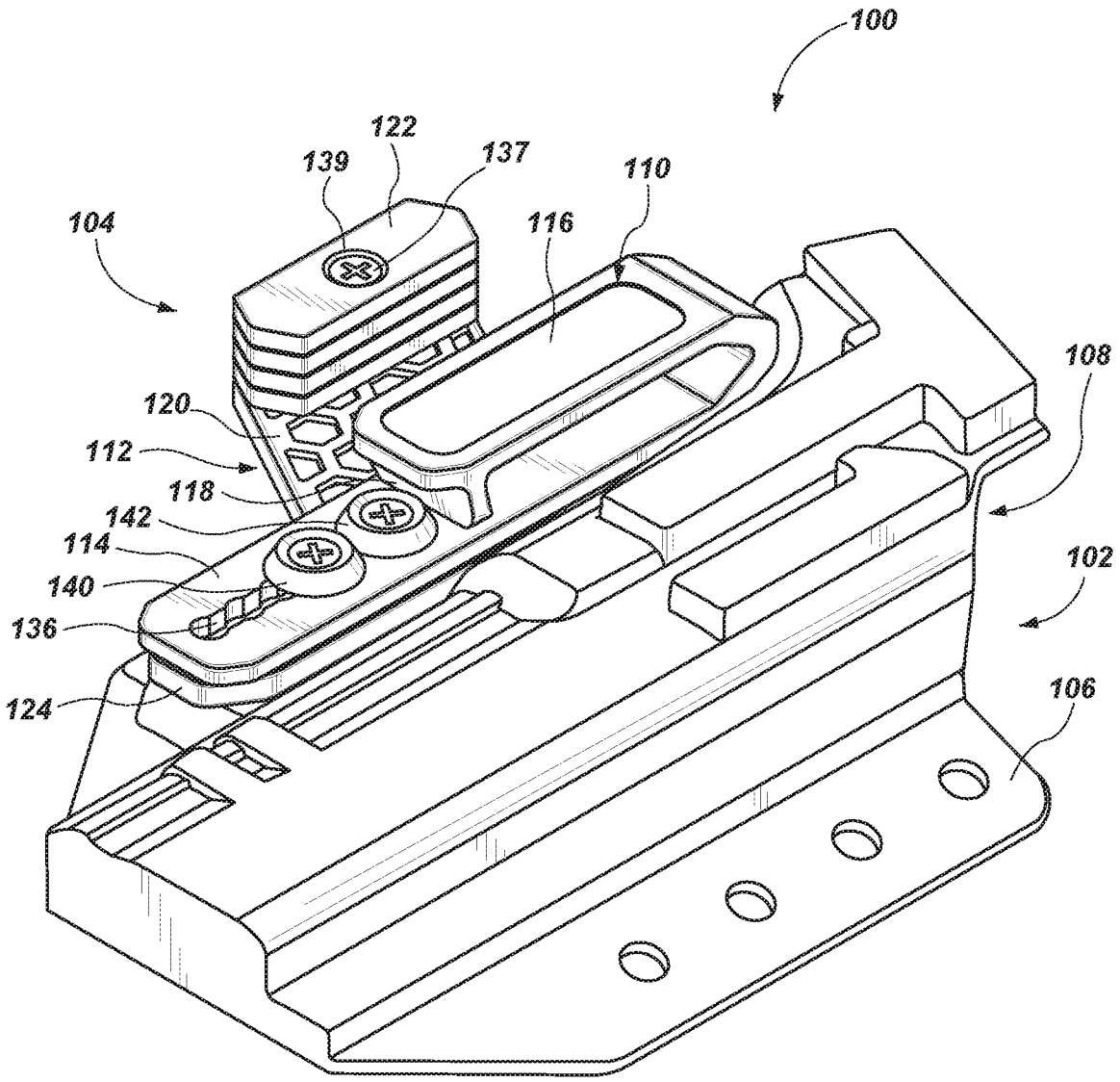
FIG. 1 is a perspective view of an inside-the-waistband firearm holster assembly and a clip and claw assembly according to one or more embodiments of the present disclosure.

The illustrations presented herein are not actual views of any firearm holster or clip and claw assembly but are merely idealized representations employed to describe example embodiments of the disclosure. In the following detailed description, reference is made to the accompanying drawings which form a part hereof, and in which is shown by way of illustration specific embodiments in which the disclosure may be practiced. These embodiments are described in sufficient detail to enable those of ordinary skill in the art to practice the disclosure. It should be understood, however, that the detailed description and the specific examples, while indicating examples of embodiments of the disclosure, are given by way of illustration only and not by way of limitation. From this disclosure, various substitutions, modifications, additions rearrangements, or combinations thereof within the scope of the disclosure may be made and will become apparent to those of ordinary skill in the art.

In accordance with common practice, the various features illustrated in the drawings may not be drawn to scale. Accordingly, the dimensions of the various features may be arbitrarily expanded or reduced for clarity. In addition, some of the drawings may be simplified for clarity. Thus, the drawings may not depict all of the components of a given apparatus or all operations of a particular method.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. Also, unless stated otherwise a set of elements may comprise one or more elements.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

Embodiments of the disclosure include an inside-the-waistband firearm holster assembly for at least partially concealing a firearm on a wearer. In particular, the firearm holster assembly is designed and intended to be positioned at least partially down the front of the pants (or similar piece of clothing (e.g., shorts, skirt, etc.)) of a wearer (e.g., as an appendix carry) and to be secured (e.g., clipped) onto the waistband and/or belt of the wearer. The firearm holster assembly may include a firearm receiving portion and a clip and claw assembly (i.e., a clothing interface assembly). The firearm receiving portion may be structured to receive a barrel of a firearm (e.g., a hand gun) and hold the firearm. The clip and claw assembly may include a clip element and a projecting element (i.e., a claw element) having one or more spacer plates stacked thereon and intended to press against an interior surface of the wearer's clothing (e.g., an interior surface of a waistband of a pair of pants or shorts, which optionally may be reinforced by a belt). Furthermore, by adjusting a number of spacer plates secured to the projecting element, a wearer may adjust a level of concealment of the firearm holster assembly (e.g., a level at which the firearm holster assembly assists in concealing a given firearm).

For example, during use, the projecting element and the stack of one or more spacer plates are oriented on a side of the firearm holster assembly below where a grip of a firearm may be positioned when the firearm is inserted into the firearm receiving portion of the firearm holster assembly. As a result, adding spacer plates may increase an amount by which the firearm holster assembly is pressed (e.g., tucked) into a wearer's body on the side of the firearm holster assembly including the projecting element. According, an amount by which a grip of a given firearm holstered within firearm holster assembly is pressed (e.g., tucked) into a wearer's body may be increased or decreased by adjusting a number of spacer plates stacked on the projecting element (i.e., the claw element). By pressing (e.g., tucking) the grip of the firearm into the wearer's body, the firearm holster assembly may increase an ability of a shirt, jackets, or other piece of clothing worn over the firearm holster assembly to conceal the firearm. For instance, the clip and claw assembly may assist in concealing a grip of the firearm, which typically, is a relatively difficult portion to effectively conceal.

Figure 2:
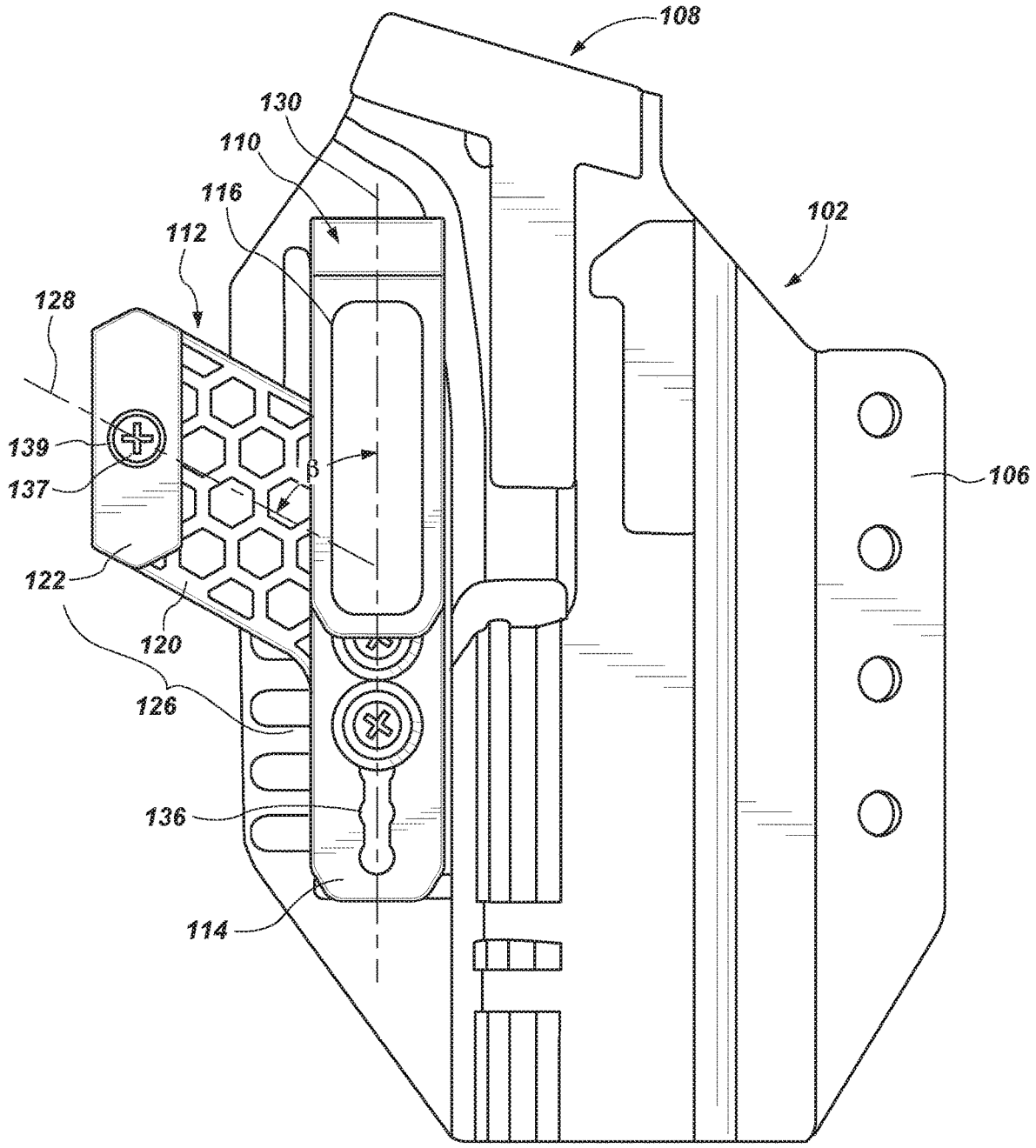
FIG. 2 is a front side view of the holster assembly and a clip and claw assembly of FIG. 1.
Figure 3:
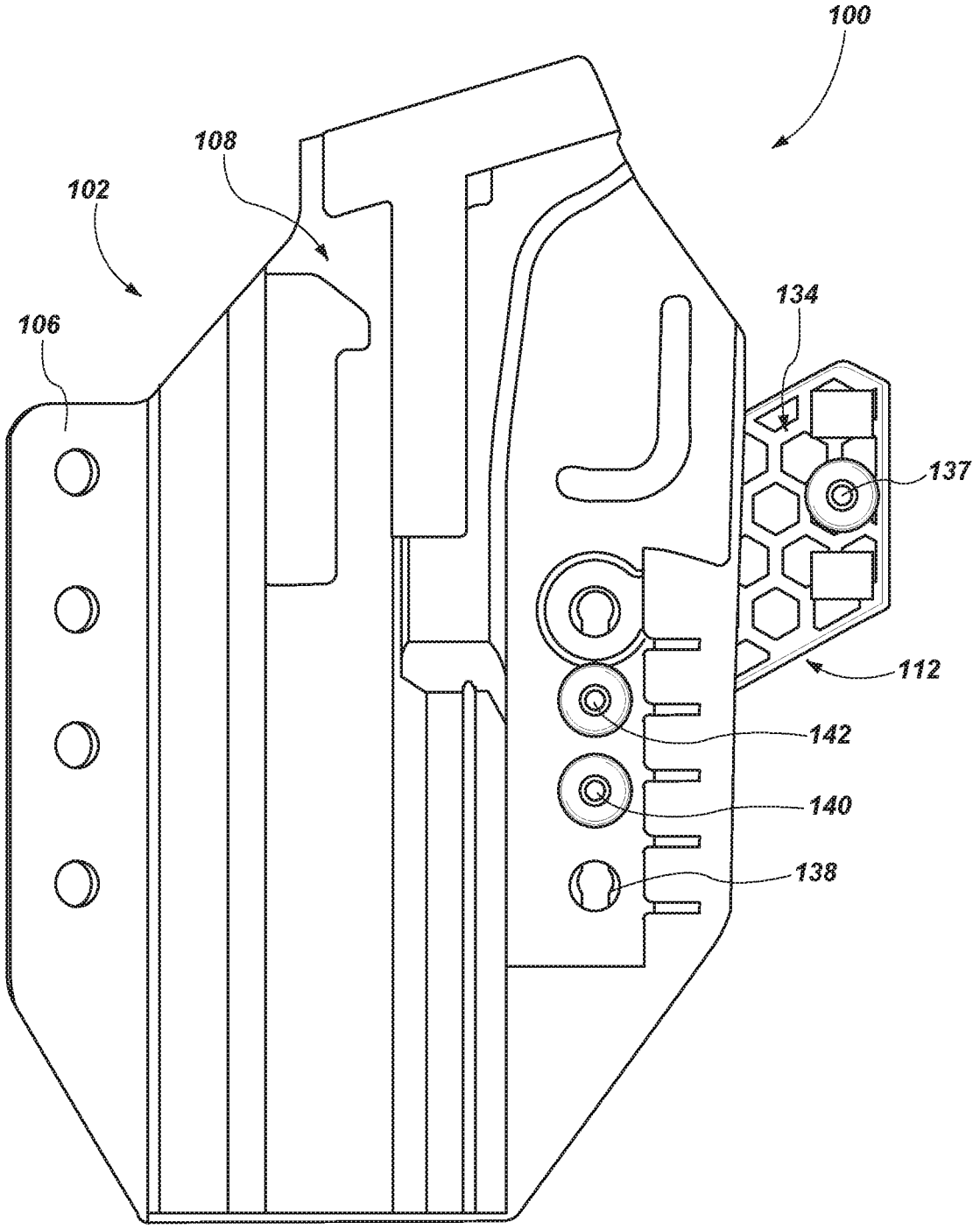
FIG. 3 is a rear side view of the holster assembly and a clip and claw assembly of FIG. 1.
Figure 4:
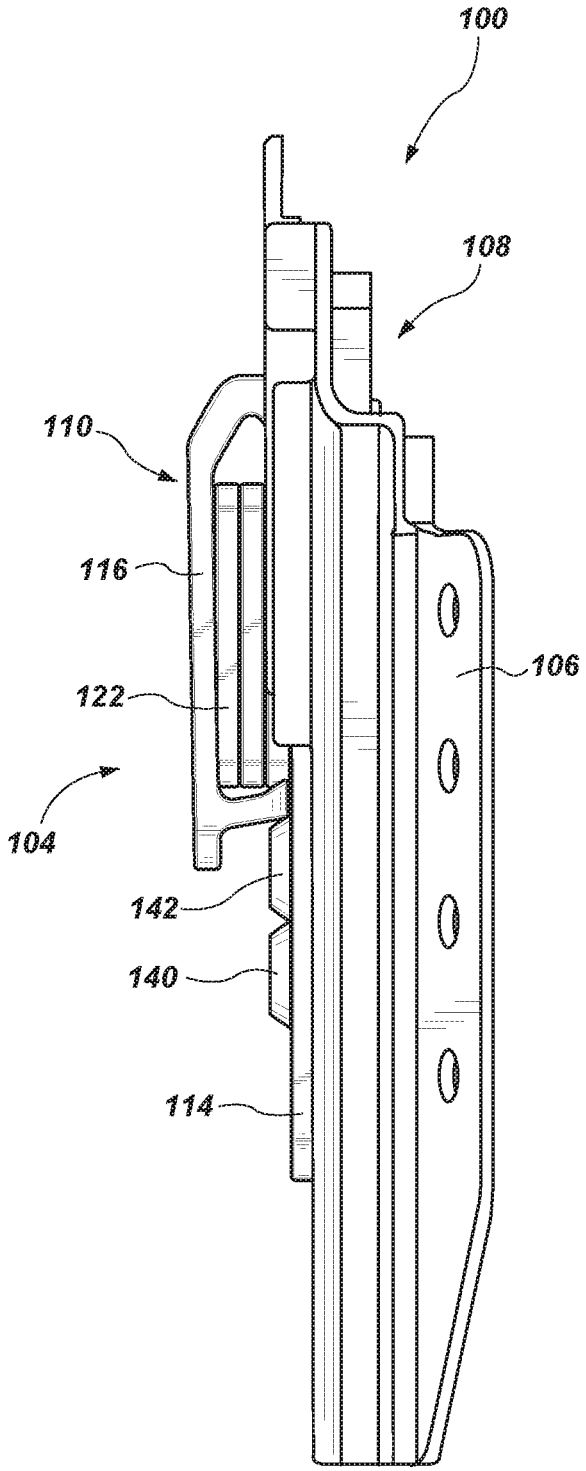
FIG. 4 is a right side view of the holster assembly and a clip and claw assembly of FIG. 1.
Figure 5:
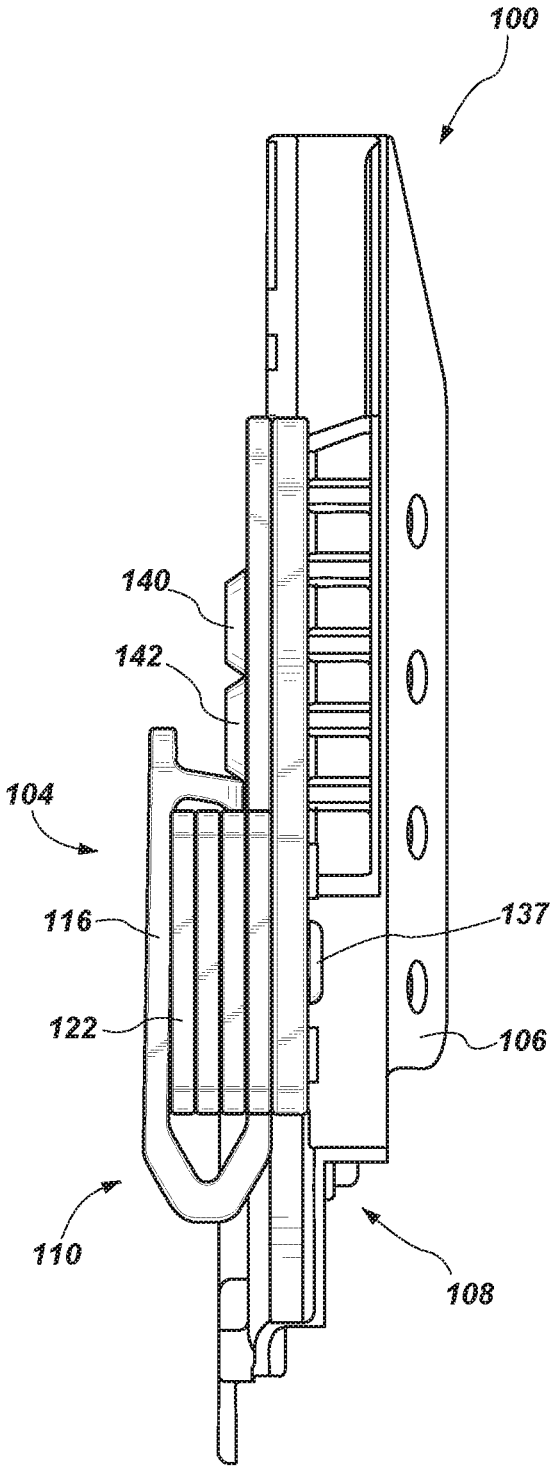
FIG. 5 is an upside down left side view of the holster assembly and a clip and claw assembly of FIG. 1.
Figure 6:
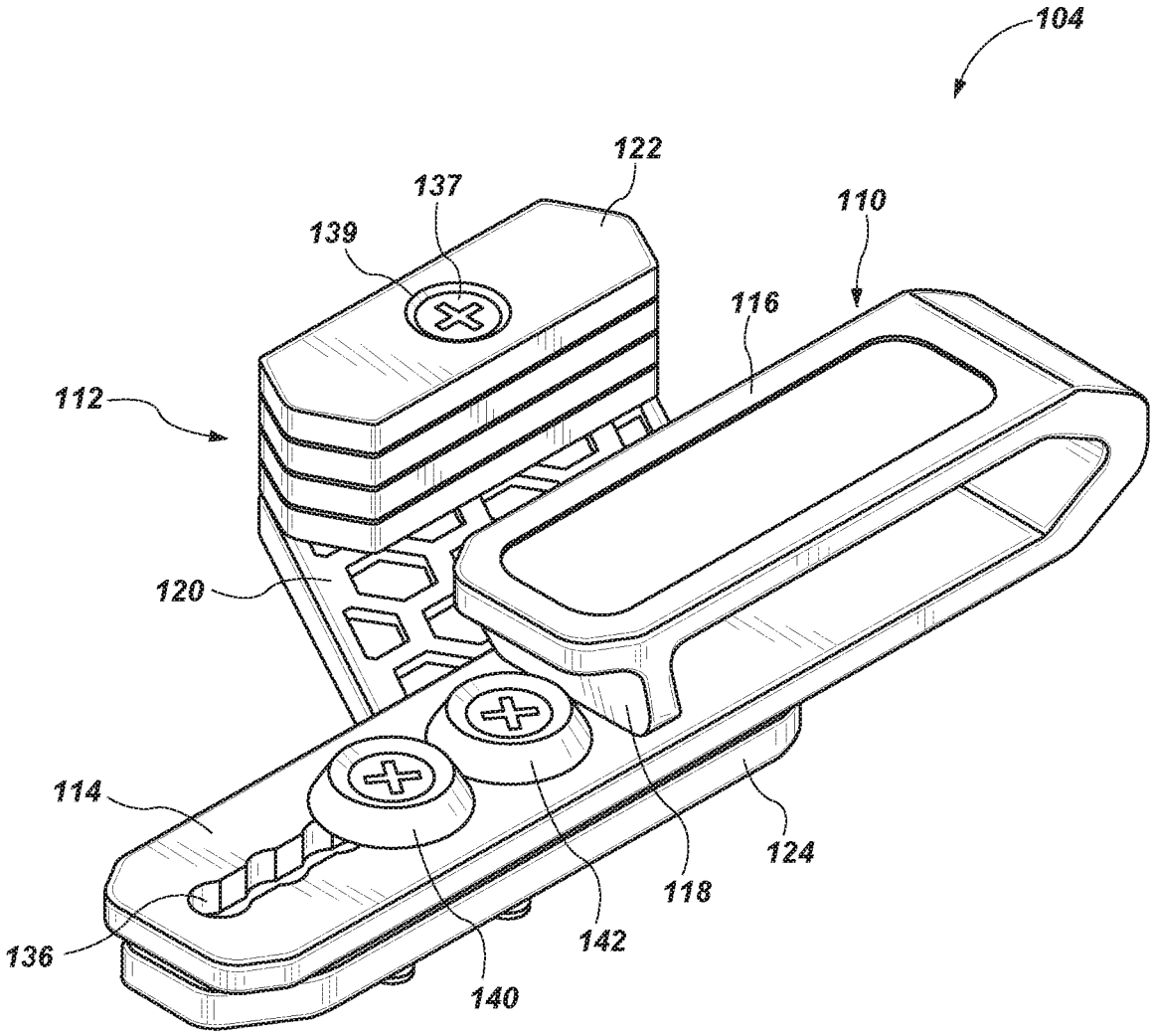
FIG. 6 is a perspective view of a clip and claw assembly according to one or more embodiments of the present disclosure.
Figure 7:
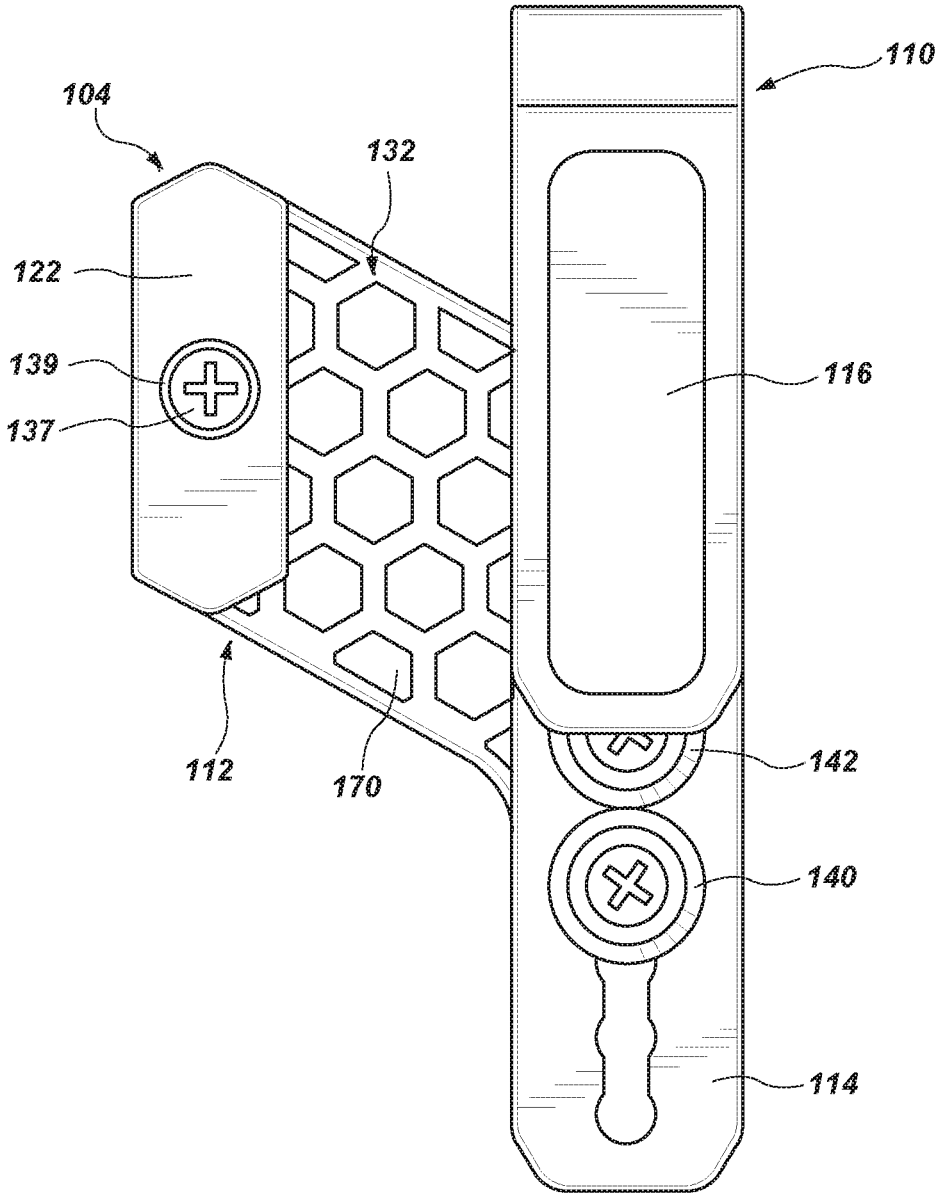
FIG. 7 is a front side view of the clip and claw assembly of FIG. 6.

FIG. 1 shows a perspective view of a firearm holster assembly 100 according to one or more embodiments of the present disclosure. FIG. 2 shows a front side view of the firearm holster assembly 100 of FIG. 1. FIG. 3 shows a rear side view of the firearm holster assembly 100 of FIG. 1. FIGS. 4 and 5 show right and left side views of the firearm holster assembly 100 of FIG. 1. Referring to FIGS. 1-5 together, the firearm holster assembly 100 may include a firearm receiving portion 102 and a clip and claw assembly 104. FIGS. 6-12 show various view of the clip and claw assembly 104 of the firearm holster assembly 100 without the firearm receiving portion 102. Referring to FIGS. 1-12 together, the clip and claw assembly 104 may be coupled (e.g., fastened) to the firearm receiving portion 102. For example, as is discussed in detail below, the clip and claw assembly 104 may be removably coupled to the firearm receiving portion 102 via one or more fasteners.

The firearm receiving portion 102 may include a body 106, and the body 106 may define a receiving aperture 108 for receiving a barrel of a firearm (e.g., a handgun). The clip and claw assembly 104 may include a clip element 110 and a claw assembly 112 (i.e., positioning assembly). The clip element 110 may include a base member 114 and a hook member 116. The hook member 116 may extend from a longitudinal end of the base member 114 and may extend back over a portion of the base member 114. The base member 114 may include an elongated flat body (e.g., a generally linear flat body), and the hook member 116 may include an elongated flat body and a catch member 118 extending from the elongated flat body and back toward the base member 114.

The claw assembly 112 may include a base plate 120 and one or more spacer plates 122. The base plate 120 may include a connection portion 124 and a projecting element 126 (i.e., claw element). In some embodiments, the connection portion 124 may include an elongated flat portion. Furthermore, the connection portion 124 may have a width at least substantially similar to the width of the base member 114 of the hook member 116. For instance, when the claw assembly 112 and the clip element 110 are coupled to the firearm receiving portion 102, the connection portion 124 of the claw assembly 112 and the base member 114 of the hook member 116 may be substantially aligned together (as depicted in FIGS. 7-10).

The projecting element 126 (i.e., claw element) may extend outward laterally from the connection portion 124. In some embodiments, a longitudinal axis 128 of the projecting element 126 of the base plate 120 may be oblique to a longitudinal axis 130 of the connection portion 124 of the base plate 120. In one or more embodiments, the longitudinal axis 128 of the projecting element 126 of the base plate 120 and the longitudinal axis 130 of the connection portion 124 of the base plate 120 may define an acute angle β therebetween (FIG. 2). In some instances, the acute angle β may be within the range of about 45° and about 80°. For example, the acute angle β may be about 60°.

The projecting element 126 and the connection portion 124 together may define a first major surface 132 (FIG. 7) and an opposing second major surface 134 (FIG. 3) of the base plate 120. The first major surface 132 of the base plate 120 may be parallel to the opposing second major surface 134 of the base plate 120. When the firearm holster assembly 100 is assembled, the first major surface 132 of the base plate 120 may face and contact the clip element 110.

In one or more embodiments, each of the one or more spacer plates 122 may have a longitudinal length at least substantially equivalent to a width of the projecting element 126 in a direction parallel to the longitudinal axis 130 of the connection portion 124 of the base plate 120. Furthermore, each of the one or more spacer plates 122 may have a general elongated diamond shape. However, each of the one or more spacer plates 122 may have any shape.

The one or more spacer plates 122 may be stacked on the first major surface 132 of the base plate 120. In some embodiments, the one or more spacer plates 122 may be stacked in a direction normal to the first major surface 132. Additionally, the one or more spacer plates 122 may be stacked on a region of the projecting element 126 opposite the connection portion 124 of the base plate 120. In some embodiments, the one or more spacer plates 122 may include two, three, four, five, or more plates. As is discussed in greater detail below, the projecting element 126 and the one or more spacer plates 122 may enable a wearer to adjust an amount by which a firearm is pressed against (e.g., tucked into) a body of a wearer, which may enable a wearer to more effectively conceal a firearm. For example, the wearer may adjust the amount by which a firearm is pressed against (e.g., tucked into) a body of a wearer by adjusting how many spacer plates 122 are stacked on the base plate 120.

In one or more embodiments, the one or more spacer plates 122 may be fastened to the base plate 120 via a fastener 137. In some embodiments, each of the one or more spacer plates 122 may include a countersink hole 139 extending therethrough. As a result, when the one or more spacer plates 122 are fastened to the base plate 120, the fastener 137 may seat (i.e., may be seated) below an outermost surface of an outermost spacer plate 122 of the one or more spacer plates 122.

In one or more embodiments, a thickness of each of the one or more spacer plates 122 may be the same as a thickness of the base member 114 of the clip element 110. In other embodiments, the thickness of each of the one or more spacer plates 122 may be greater or less than a thickness of the base member 114 of the clip element 110. In one or more embodiments, each of the one or more spacer plates 122 may have a thickness within a range of about 0.125 inch and about 1.0 inch. In some embodiments, each of the one or more spacer plates 122 may have a thickness within a range of about 0.25 inch and about 0.75 inch. For example, each of the one or more spacer plates 122 may have a thickness of about 0.25 inch.

As mentioned below, the one or more spacer plates 122 may enable a wearer to adjust a level of concealment of the firearm holster assembly 100 (e.g., a level at which the firearm holster assembly 100 assists in concealing a given firearm). In particular, during use, the stack of one or more spacer plates 122 may press against an interior surface of a waistband of a piece of clothing (e.g., pants) of the wearer. Furthermore, during use, the projecting element 126 and the stack of one or more spacer plates 122 are oriented on a side of the firearm holster assembly 100 above which a grip of a given firearm may be positioned when the given firearm is inserted into the firearm receiving portion 102 of the firearm holster assembly 100. As a result, adding spacer plates 122 to the stack of one or more spacer plates 122 may increase an amount by which the firearm holster assembly 100 is pressed (e.g., tucked) into a wearer's body on the side of the projecting element 126 and the stack of one or more spacer plates 122. According, an amount by which a grip of a given firearm holstered within firearm holster assembly 100 is pressed (e.g., tucked) into a wearer's body may be adjusted by adding or removing spacer plates from the projecting element 126. By pressing (e.g., tucking) the grip of the firearm into the wearer's body, the firearm holster assembly 100 may increase an ability of a shirt or other piece of clothing worn over the firearm holster assembly 100 to conceal the firearm and especially the grip of the firearm, which typically, is a relatively difficult portion to effectively conceal. As a result, one or more spacer plates 122 may enable a wearer to adjust a level of concealment of the firearm holster assembly 100 based on the wearer's body type and clothes being worn by the wearer.

Figure 8:
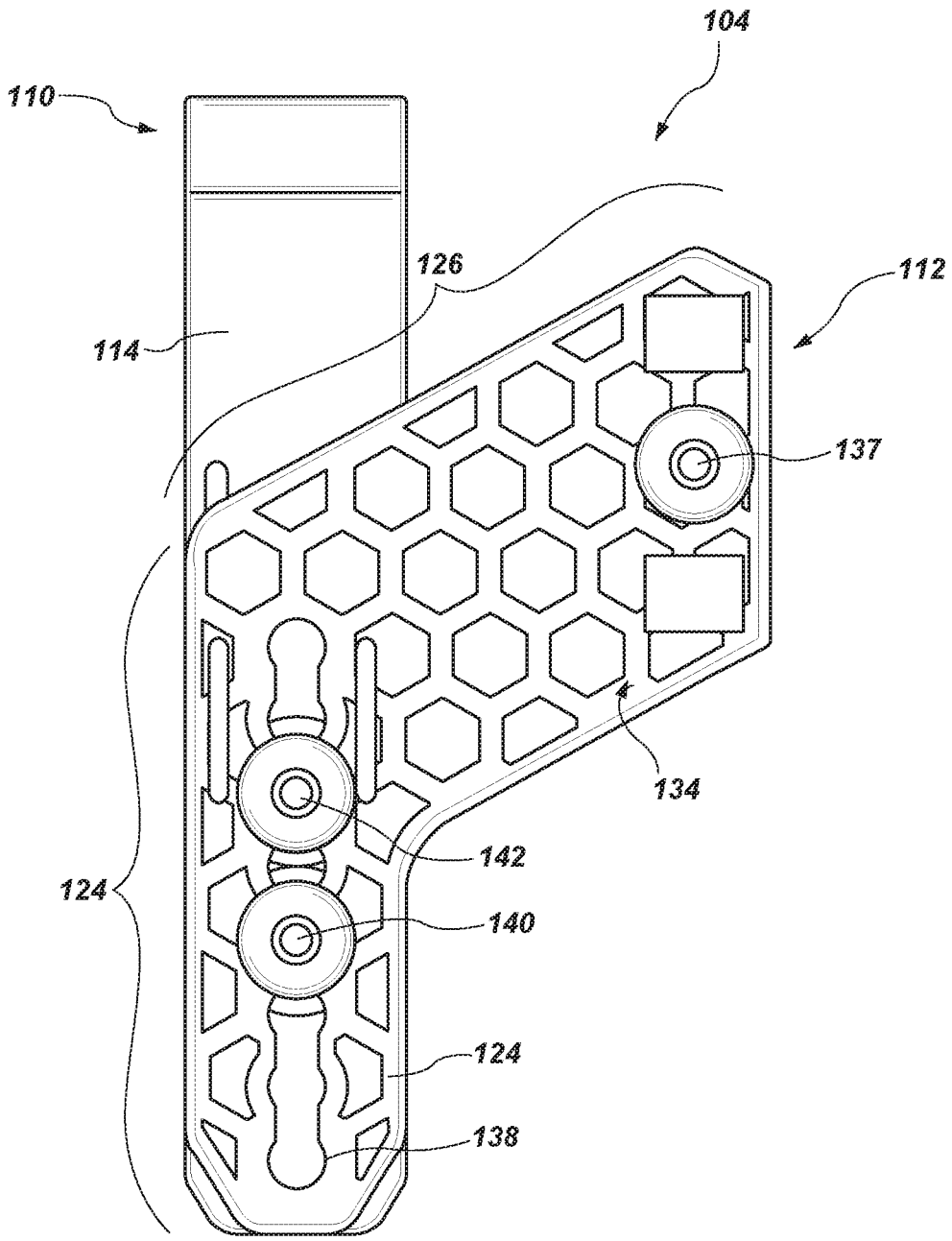
FIG. 8 is a rear side view of the clip and claw assembly of FIG. 6.
Figure 9:
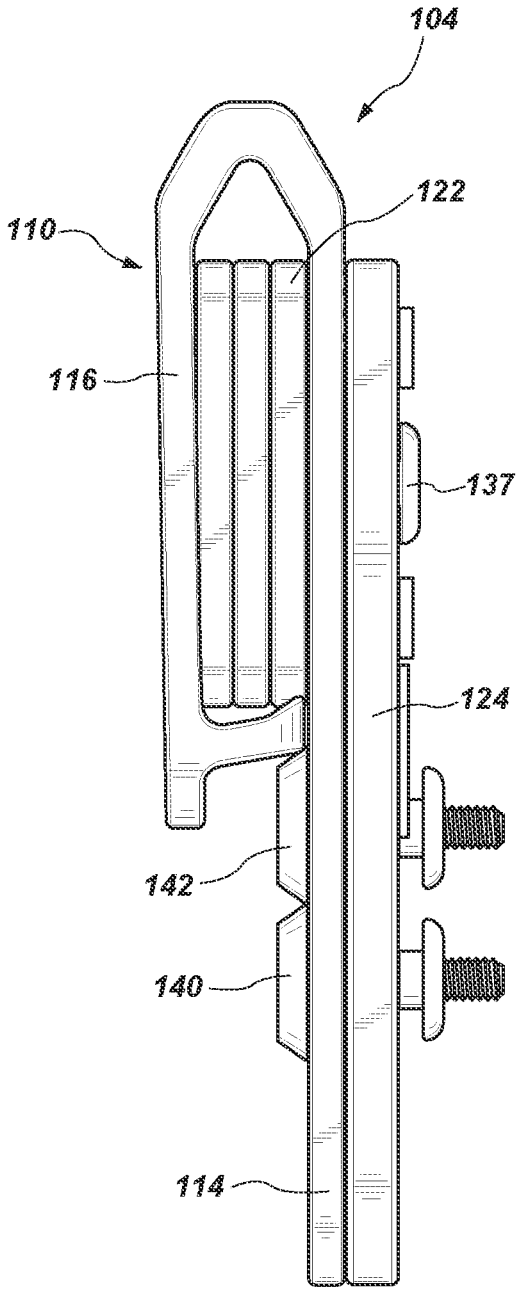
FIG. 9 is a right side view of the clip and claw assembly of FIG. 6.
Figure 10:
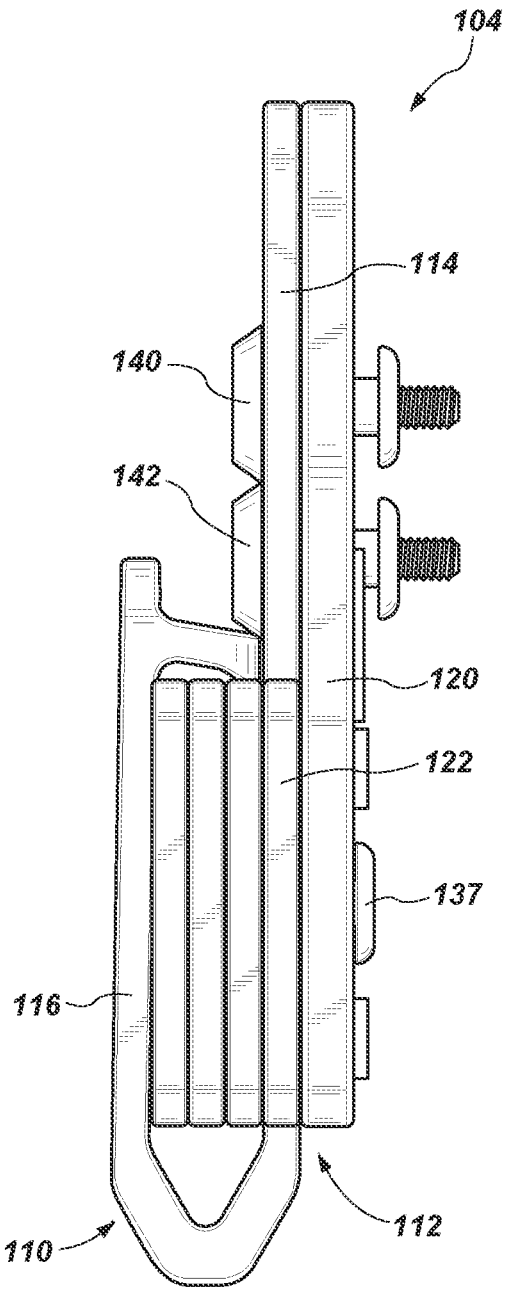
FIG. 10 is a upside down left side view of the clip and claw assembly of FIG. 6.
Figure 11:
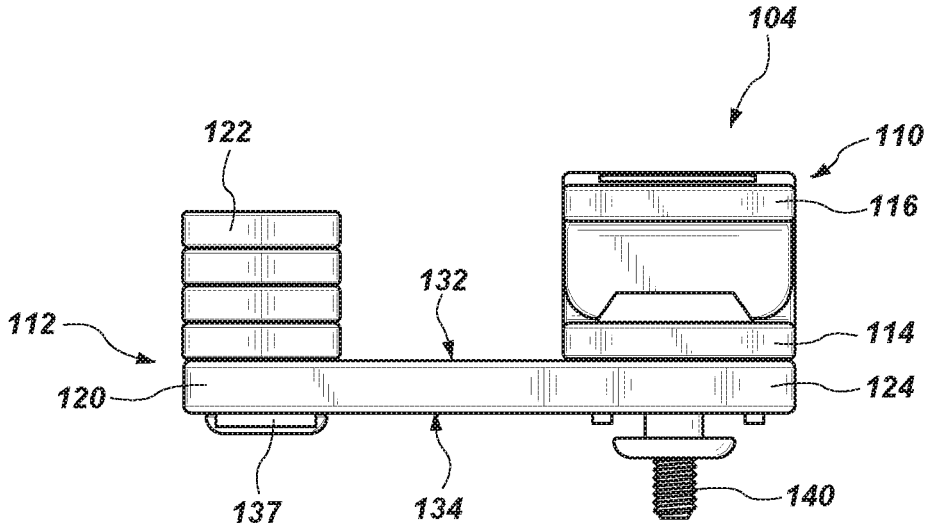
FIG. 11 is a bottom side view of the clip and claw assembly of FIG. 6.
Figure 12:
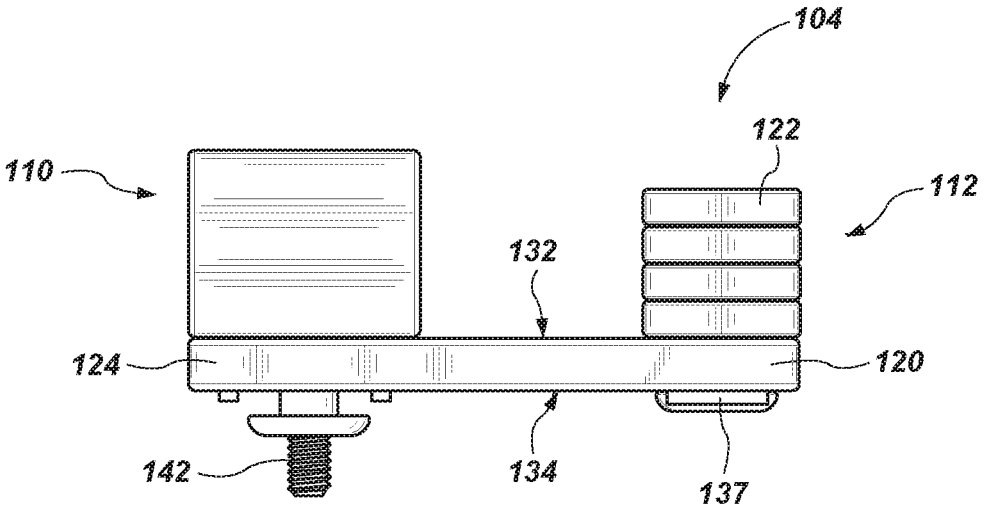
FIG. 12 is a top side view of the clip and claw assembly of FIG. 6.

In some embodiments, the clip element 110 may include a first elongated aperture 136 and the claw assembly 112 may include a second elongated aperture 138 (FIG. 8). The first elongated aperture 136 may extend through the base member 114 of the clip element 110, and the second elongated aperture 138 may extend through the connection portion 124 of the base plate 120 and from the first major surface 132 to the second major surface 134. Each of the first and second elongated apertures 136, 138 may include a plurality of circular aperture portions oriented in series relative to each other. For instance, the plurality of circular aperture portions may be oriented next to each other in a linear pattern. Furthermore, adjacent circular aperture portions of the plurality of circular aperture portions of each of the first and second elongated apertures 136, 138 may be connected together (e.g., joined together) with a linear aperture portion.

In one or more embodiments, one or more fasteners 140, 142 may fasten the clip element 110 and the base plate 120 to the firearm receiving portion 102. For example, the one or more fasteners may extend through the first elongated aperture 136 of the clip element 110 and through the second elongated aperture 138 and into receiving apertures of the firearm receiving portion 102.

In some embodiments, the clip element 110 and the claw assembly 112 may be translatable relative to the firearm receiving portion 102 and relative to each other. For example, each of the clip element 110 and the claw assembly 112 may be translatable along a longitudinal length of a respective elongated aperture (i.e., the first or second elongated apertures 136, 138). As a non-limiting example, during use, the one or more fasteners 140, 142 may be loosened and positions of the clip element 110 and the claw assembly 112 may be adjusted by sliding the clip element 110 and/or the claw assembly 112 in first or second directions (e.g., up or down) along the longitudinal length of a respective elongated aperture (i.e., the first or second elongated aperture 136, 138). Upon positioning the clip element 110 and the claw assembly 112, the one or more fasteners 140, 142 may be refastened to hold the clip element 110 and the claw assembly 112 in place. As a result, the firearm holster assembly 100 may be adjustable to fit a given wearer and/or wardrobe. For example, the positions of the clip element 110 and/or the claw assembly 112 may be adjusted to accommodate a size of a wearer and/or a style of clothing. For instance, the positions of the clip element 110 and/or the claw assembly 112 may be adjusted depending of a body type of the wearer, depending on a width of a waistband of and/or type of pants being worn by a wearer, depending on a size and/or type of belt being worn by the wearer and/or depending on how the wearer wants to wear the firearm holster assembly 100 (e.g., deeper lower below the waistband or higher above a waistband). Additionally, enabling the clip element 110 and the claw assembly 112 to be positioned and adjusted relative to one another and relative to the firearm receiving portion 102 of the firearm holster assembly 100 may allow a wearer to define a space between the claw assembly 112 and a grip of a firearm (e.g., a purchase area). As a result, a wearer can determine a space that fits the wearer's body type, hand size, and/or comfort for drawing the firearm.

Furthermore, the first or second elongated apertures 136, 138 of the clip element 110 and the claw assembly 112 may enable a wearer to quickly adjust a position of the clip element 110 and/or the claw assembly 112 without disassembling the firearm holster assembly 100. For example, positions of the clip element 110 and the claw assembly 112, and as a result, a position of the firearm holster assembly 100 relative to a wearer may be quickly adjusted without requiring disassembling of the firearm holster assembly 100. For instance, in use, the one or more fasteners 140, 142 may be loosened, the clip element 110 and/or the claw assembly 112 may be moved along longitudinal lengths of the first or second elongated apertures 136, 138 to desired positions, and the one or more fasteners 140, 142 may be refastened without requiring complete removal of the clip and claw assembly 104 from the firearm receiving portion 102.

In one or more embodiments, one or more portions of the clip and claw assembly 104 and/or one or more portions of the firearm receiving portion 102 may include one or more of a polymer material, a metal material, or a metal alloy material. For example, one or more portions of the clip and claw assembly 104 and/or one or more portions of the firearm receiving portion 102 may include a thermoplastic (e.g., acrylonitrile butadiene styrene (ABS)), polycarbonate, polypropylene, or polychlorotrifluoroethylene. As another non-limiting example, one or more portions of the clip and claw assembly 104 and/or one or more portions of the firearm receiving portion 102 may include stainless steel, steel, aluminum, or any other metal or alloy.

Embodiments of the present disclosure further include the following embodiments:

Embodiment 1. A firearm holster assembly, comprising: a firearm receiving portion; and a clip and claw assembly coupled to the firearm receiving portion, the clip and claw assembly comprising: a clip element configured to engage a piece of clothing of a wearer; and a claw assembly comprising: a base plate movably coupled to the firearm receiving portion, the base plate comprising: a connection portion oriented between the clip element and the firearm receiving portion; and a projecting element extending outward laterally from the connection portion, the connection portion and the projecting element together defining a first major surface and a second opposite major surface of the base plate, the first major surface configured to face outward from a body of the wearer; and one or more spacer plates coupled to and stacked on the first major surface of the first and second major surfaces.

Embodiment 2. The firearm holster assembly of embodiment 1, wherein the clip element and the claw assembly are translatable in a first direction and a second, opposite direction relative to the firearm receiving portion and relative to each other.

Embodiment 3. The firearm holster assembly of any one of embodiments 1 or 2, wherein the base plate of the claw assembly further comprises an elongated aperture extending through the connection portion of the base plate and extending from the first major surface to the second major surface of the base plate.

Embodiment 4. The firearm holster assembly of embodiment 3, wherein the elongated aperture comprises a plurality of circular aperture portions oriented relative to each other in a linear pattern and joined together with linear aperture portions.

Embodiment 5. The firearm holster assembly of any one of embodiments 3 or 4, wherein the clip element further comprises an additional elongated aperture extending through the clip element and oriented to at least partially align with the elongated aperture of the base plate.

Embodiment 6. The firearm holster assembly of embodiment 5, further comprising one or more fasteners extending through the elongated aperture of the base plate and the additional elongated aperture of the clip element and coupling the clip and claw assembly to the firearm receiving portion.

Embodiment 7. The firearm holster assembly of any one of embodiments 1 through 6, wherein a longitudinal axis of the projecting element of the base plate is oblique to a longitudinal axis of the connection portion of the base plate.

Embodiment 8. The firearm holster assembly of any one of embodiments 1 through 7, wherein the one or more spacer plates comprises one, two, three, four, or more spacer plates.

Embodiment 9. The firearm holster assembly of any one of embodiments 1 through 8, further comprising an additional fastener securing the one or more spacer plates to the base plate of the clip and claw assembly.

Embodiment 10. The firearm holster assembly of any one of embodiments 1 through 9, wherein the one or more spacer plates are stacked in a direction normal to the first major surface of the base plate.

Embodiment 11. A clip and claw assembly for attaching a firearm holster assembly to one or more pieces of clothing of a wearer, the clip and claw assembly comprising: a clip element configured to engage a piece of clothing of the wearer; a claw assembly comprising: a base plate comprising: a connection portion oriented adjacent to the clip element; and a projecting element extending outward laterally from the connection portion, the connection portion and the projecting element together defining a first major surface and a second opposite major surface of the base plate, the first major surface configured to face outward from a body of the wearer; and one or more spacer plates coupled to and stacked on the first major surface of the base plate.

Embodiment 12. The clip and claw assembly of embodiment 11, wherein the clip element comprises: a base member; and a hook member extending back over a portion of the base member.

Embodiment 13. The clip and claw assembly of any one of embodiments 11 or 12, wherein the base plate of the claw assembly further comprises an elongated aperture extending through the connection portion of the base plate and extending from the first major surface and to the second major surface of the base plate.

Embodiment 14. The clip and claw assembly of embodiment 13, wherein the elongated aperture comprises a plurality of circular aperture portions oriented in a linear pattern relative to one another and joined together with linear aperture portions.

Embodiment 15. The clip and claw assembly of any one of embodiments 13 or 14, wherein the clip element further comprising an additional elongated aperture extending through the clip element and oriented to at least partially align with the elongated aperture of the base plate.

Embodiment 16. The clip and claw assembly of any one of embodiments 11 through 15, wherein the one or more spacer plates comprises one, two, three, four, or more spacer plates.

Embodiment 17. The clip and claw assembly of any one of embodiments 11 through 16, wherein the one or more spacer plates are stacked in a direction normal to the first major surface of the base plate.

Embodiment 18. A method of making a clip and claw assembly, the method comprising: forming a claw assembly comprising: forming a base plate comprising: forming a connection portion; and forming a projecting element extending outward laterally from the connection portion, the connection portion and the projecting element together defining a first major surface and a second opposite major surface of the base plate, the first major surface configured to face outward from a body of a wearer; and forming one or more spacer plates and stacking the one or more spacer plates on the first major surface of the base plate.

Embodiment 19. The method of embodiment 18, further comprising forming a clip member and fastening the claw assembly to the clip member.

Embodiment 20. The method of any one of embodiments 18 or 19, further comprising attaching the clip and claw assembly to a firearm receiving portion.

While the disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the invention as claimed, including legal equivalents thereof. In addition, features from one embodiment may be combined with features of another embodiment while still being encompassed within the scope of the disclosure as contemplated by the inventors. Further, embodiments of the disclosure have utility with different and various tool types and configurations.

What is claimed is:

1. A firearm holster assembly, comprising:
- a firearm receiving portion; and
- a clip and claw assembly coupled to the firearm receiving portion, the clip and claw assembly comprising:
  - a clip element configured to engage a piece of clothing of a wearer; and
  - a claw assembly comprising:
    - a base plate movably coupled to the firearm receiving portion, the base plate comprising:
      - a connection portion oriented between the clip element and the firearm receiving portion; and
      - a projecting element extending outward laterally from the connection portion, the connection portion and the projecting element together defining a first major surface and a second opposite major surface of the base plate, the first major surface configured to face outward from a body of the wearer; and
  - one or more spacer plates coupled to and stacked on the first major surface of the first and second opposite major surfaces;
  - wherein each of the clip element and the claw assembly are translatable in a first direction and a second direction, opposite the first direction, relative to the firearm receiving portion and relative to each other.

2. The firearm holster assembly of claim 1, wherein the base plate of the claw assembly further comprises an elongated aperture extending through the connection portion of the base plate and extending from the first major surface to the second opposite major surface of the base plate, the elongated aperture configured for moveably coupling the claw assembly relative to the firearm receiving portion and the clip element.

3. The firearm holster assembly of claim 2, wherein the elongated aperture comprises a plurality of circular aperture portions oriented relative to each other in a linear pattern and joined together with linear aperture portions.

4. The firearm holster assembly of claim 2, wherein the clip element further comprises a base member, the base member comprising an additional elongated aperture extending through the clip element and oriented to at least partially align with the elongated aperture of the base plate, the additional elongated aperture configured for movably coupling the clip element relative to the firearm receiving portion and the claw assembly.

5. The firearm holster assembly of claim 4, further comprising one or more fasteners extending through the elongated aperture of the base plate and the additional elongated aperture of the clip element and coupling each of the clip element and the claw assembly to the firearm receiving portion.

6. The firearm holster assembly of claim 1, wherein a longitudinal axis of the projecting element of the base plate is oblique to a longitudinal axis of the connection portion of the base plate.

7. The firearm holster assembly of claim 1, wherein the one or more spacer plates comprises one, two, three, four, or more spacer plates, and wherein each of the one or more spacer plates is stackable with other spacer plates.

8. The firearm holster assembly of claim 1, further comprising an additional fastener securing the one or more spacer plates to the base plate of the clip and claw assembly.

9. The firearm holster assembly of claim 1, wherein the one or more spacer plates are stacked in a direction normal to the first major surface of the base plate.

10. A clip and claw assembly for attaching a firearm holster assembly to one or more pieces of clothing of a wearer, the clip and claw assembly comprising:
- a clip element configured to engage a piece of clothing of the wearer;
- a claw assembly comprising:
  - a base plate comprising:
    - a connection portion oriented adjacent to the clip element; and
    - a projecting element extending outward laterally from the connection portion, the connection portion and the projecting element together defining a first major surface and a second opposite major surface of the base plate, the first major surface configured to face outward from a body of the wearer; and
  - one or more spacer plates coupled to and stacked on the first major surface of the base plate, each of the one or more spacer plates being configured to stack with other spacer plates.

11. The clip and claw assembly of claim 10, wherein the clip element comprises:

a base member; and a hook member extending back over a portion of the base member.

12. The clip and claw assembly of claim 10, wherein the base plate of the claw assembly further comprises an elongated aperture extending through the connection portion of the base plate and extending from the first major surface and to the second major surface of the base plate.

13. The clip and claw assembly of claim 12, wherein the elongated aperture comprises a plurality of circular aperture portions oriented in a linear pattern relative to one another and joined together with linear aperture portions.

14. The clip and claw assembly of claim 12, wherein the clip element further comprising an additional elongated aperture extending through the clip element and oriented to at least partially align with the elongated aperture of the base plate.

15. The clip and claw assembly of claim 10, wherein the one or more spacer plates comprises one, two, three, four, or more spacer plates.

16. The clip and claw assembly of claim 10, wherein the one or more spacer plates are stacked in a direction normal to the first major surface of the base plate.

17. The clip and claw assembly of claim 10, wherein the clip element and the claw assembly are configured to movably couple to each other and moveably couple to the firearm holster assembly.

18. A method of making a clip and claw assembly for attaching a firearm holster assembly to one or more pieces of clothing of a wearer, the method comprising:

forming a clip element configured to engage a piece of clothing of the wearer;

forming a claw assembly comprising:

forming a base plate comprising:

forming a connection portion configured to be oriented adjacent to the clip element; and forming a projecting element extending outward laterally from the connection portion, the connection portion and the projecting element together defining a first major surface and a second opposite major surface of the base plate, the first major surface configured to face outward from a body of a wearer; and forming one or more spacer plates and stacking the one or more spacer plates on the first major surface of the base plate, each of the one or more spacer plates being configured to stack with other spacer plates; and fastening the claw assembly to the clip element.

19. The method of claim 18, wherein fastening the claw assembly to the clip element includes selecting a relative positioning between the claw assembly and the clip element, the method further comprising attaching the clip and claw assembly to a firearm receiving portion.

* * * * *